US005858918A

United States Patent [19]

Shirai et al.

[11] Patent Number: 5,858,918

[45] Date of Patent: Jan. 12, 1999

[54] THERMAL TRANSFER IMAGE-RECEIVING SHEET

[75] Inventors: Koichi Shirai; Kazunobu Imoto; Atsushi Mutou, all of Shinjuku-ku, Japan

[73] Assignee: Dai Nippon Printing Co., Ltd., Japan

[21] Appl. No.: 877,892

[22] Filed: Jun. 18, 1997

[30] Foreign Application Priority Data

Jun. 20, 1996 [JP] Japan ..... 8-178697

[51] Int. Cl.[6] ..... B41M 5/035; B41M 5/38

[52] U.S. Cl. ..... 503/227; 428/195; 428/211; 428/304.4; 428/913; 428/914

[58] Field of Search ..... 8/471; 428/195, 428/211, 304.4, 913, 914; 503/227

[56] References Cited

U.S. PATENT DOCUMENTS 4,992,414 2/1991 Kishida et al. .

*Primary Examiner*—Bruce H. Hess
*Attorney, Agent, or Firm*—Parkhurst & Wendel, L.L.P.

[57] ABSTRACT

A thermal transfer image-receiving sheet having a substrate composed of paper or a paper-containing laminate is free from surface undulations or irregularities extending over several millimeters or more related to appearance and quality, has excellent printability, and gives high smoothness and a quality appearance. Concretely, a substrate 1 is composed of paper with an average area per flock of 6 $mm^2$ or less, and a coloring material receptive layer 2 is formed on the substrate to constitute a thermal transfer image-receiving sheet 10. A resin layer 4 having fine voids inside is provided at least on the surface of the substrate 1 on the side where the coloring material receptive layer 2 is laminated.

3 Claims, 1 Drawing Sheet

THERMAL TRANSFER IMAGE-RECEIVING SHEET

TECHNICAL FIELD

This invention relates to a thermal transfer image-receiving sheet which is superimposed on a thermal transfer sheet and receives a coloring material thermally transferred by a thermal head as a device to form an image. More specifically, the invention relates to a thermal transfer image-receiving sheet which finds use in a thermal transfer system using a sublimable dye as a coloring material, which gives a full color, high density, high definition recorded image, which is free from visually noticed undulations or irregularities, and which has high smoothness and a quality appearance.

BACKGROUND ART

Among various thermal transfer recording systems is a known sublimation transfer recording system which uses a sublimable dye as a coloring material and employs a thermal head heating in response to a record signal to transfer it to an image-receiving sheet, thereby obtaining an image. With this recording system, the coloring material is a sublimable dye capable of density gradation. Thus, the resulting image is very sharp, excellent in halftone color reproduction, and comparable in image quality to silver salt photography.

Thus, the sublimation transfer recording system is utilized widely. Its uses, for instance, cover proof sheets, digital image outputs such as CAD/CAM and CG, outputs from various medical analyzing or measuring instruments, such as CT scans or endoscopic pictures, substitutes for instant photographs, outputs such as face photos on cards, including ID cards, photo-montages in amusement facilities such as recreation parks, and photographic records.

The thermal transfer image-receiving sheet for sublimation transfer (hereinafter referred to as the image-receiving sheet) used in a variety of fields generally comprises a coloring material receptive layer formed on a substrate.

Needless to say, major requirements for the image-receiving sheet are high print sensitivity and stability to curl before and after printing. Thus, a substrate used for the sheet is paper, or a laminate having a resin layer containing fine voids inside, such as a plastic film or synthetic paper, laminated on one or both surfaces of paper.

Recently, as the above-described uses diversify and broaden, the market's demand for the appearance of the image-receiving sheet, such as smoothness, has become intense. Concretely, smoothness enough to be free from visually noticed undulations or irregularities has been demanded.

When the substrate of the aforementioned structure is used, however, irregularities or undulations probably associated with paper contained in the substrate appear on the surface. Thus, the desired smoothness has not been achieved easily, and the quality appearance of the image-receiving sheet has been impaired.

To solve these problems, extensive studies have been conducted. Japanese Laid-Open Patent Publication No. 227172/94, for example, describes paper with a smoothness of 20 to 120 seconds (Beck tester). Japanese Laid-Open Patent Publication No. 227173/94 describes defining the thickness nonuniformity index of paper in the direction of paper making.

These parameters are suitable for expressing tiny irregularities measuring about several tens of micrometers to 1 mm which are concerned with a lack of image or print density nonuniformity during printing. This is because the resolution of the thermal head, the device of the sublimation transfer recording system, is 200 to 300 dots per inch and conforms to the above range.

However, those parameters are not necessarily suitable for detecting or expressing the undulations or irregularities extending over several millimeters or more that affect the appearance and quality. Even paper which fulfills the required smoothness or thickness nonuniformity index has still been unsatisfactory in visual undulations or irregularities.

The present invention has been accomplished under these circumstances. It aims to solves the problem of tiny irregularities on the paper surface and the problem of undulations or irregularities as large as several millimeters that are associated with appearance and quality. By this solution, the invention intends to provide a thermal transfer image-receiving sheet excellent in print sensitivity and stability to curl, free from visually noticed undulations or irregularities on the surface, and having high smoothness and a quality appearance.

DISCLOSURE OF THE INVENTION

The inventors have conducted in-depth studies in an attempt to solve the foregoing problems. It has found that visual undulations or irregularities on the surface of the image-receiving sheet are greatly affected by the smoothness of the substrate, especially the smoothness of a paper for use as the substrate, and the sizes of flocks of the paper. Based on this finding, they have strictly restricted the average area of each flock of the paper to a certain value or less, thereby succeeding in solving the aforementioned problems.

That is, the visually noticed surface undulations or irregularities in the appearance of the image-receiving sheet are ascribed mainly to the texture of paper, more specifically, the flocks of the paper. These flocks arise from factors, including the conditions for use in paper making, such as the type, fiber length, and state of beating of pulp, the type of the paper machine, and the rate of paper making, as well as wire marks of the paper machine.

In plain paper, the flocks have different sizes. In the present invention, paper with an area of 6 $mm^2$ or less per flock is used. Thus, the texture has been improved, and problems with appearance, such as undulations or irregularities, on the surface of the image-receiving sheet have been solved.

That is, the present invention is a thermal transfer image-receiving sheet comprising a substrate composed of a paper or a laminate comprising a paper, and a coloring material receptive layer formed on at least one surface of the substrate, in which the average area per flock of the paper for use in the substrate is 6 $mm^2$ or less.

In the present invention, the substrate may further have a resin layer having fine voids at least on the surface of the substrate on the side where the coloring material receptive layer is formed.

BEST MODE FOR CARRYING OUT THE INVENTION

Embodiments of the materials and processing methods for the thermal transfer image-receiving sheet of the present invention will now be described with reference to the accompanying drawings.

FIGS. 1, 2, 3 and 4 are each a schematic sectional view showing the structure of an embodiment of a thermal transfer image-receiving sheet according to the present invention. However, the structure of the thermal transfer image-receiving sheet of the present invention is not restricted to these drawings. In the different drawings, the same numerals have been assigned to the same parts.

Figure 1:
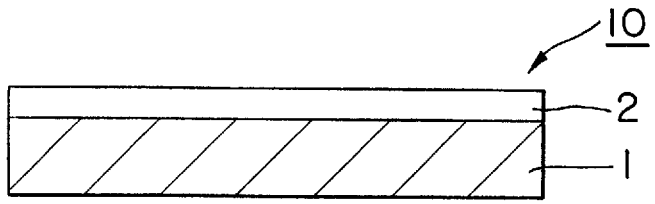
FIGS. 1, 2, 3 and 4 are each a schematic sectional view showing the construction of an embodiment of a thermal transfer image-receiving sheet according to the present invention.

FIG. 1 shows a thermal transfer image-receiving sheet 10 having a coloring material receptive layer 2 on one surface of a substrate 1, the coloring material receptive layer 2 accepting a coloring material, such as a dye, for forming an image by thermal transfer. This is the simplest structure.

Figure 2:
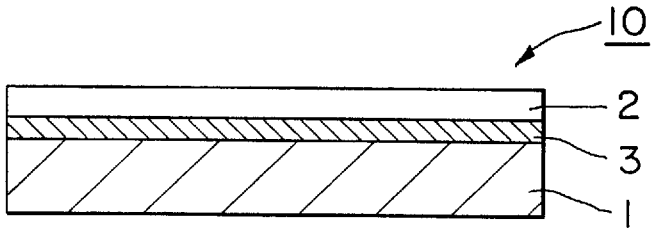

FIG. 2 shows a thermal transfer image-receiving sheet 10 having an intermediate layer 3 on one surface of a substrate 1, and further having a coloring material receptive layer 2 thereon. The intermediate layer 3 is provided if desired. This layer 3 may be composed of a suitable material freely selected, or suitable materials freely combined together, for the purpose intended. If the bonding between the substrate 1 and the coloring material receptive layer 2 is weak, for instance, the intermediate layer 3 may be a resin layer for improving the bonding properties (a primer layer or an adhesive resin layer). If the whiteness of the substrate 1 is insufficient, the intermediate layer 3 may be a white resin layer containing a white pigment, a brightening agent or the like added to a binder. If antistatic properties are required, an antistatic agent may also be added. For not only a single purpose but also a plurality of purposes, suitable materials may be combined to form the intermediate layer 3 attaining the plural purposes.

Figure 3:
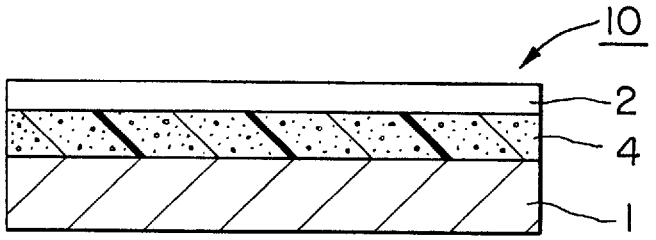

FIG. 3 shows a thermal transfer image-receiving sheet 10 which has a resin layer 4 on one surface of a substrate 1, the resin layer 4 having fine voids for imparting a satisfactory cushioning effect to improve printability; and which further has a coloring material receptive layer 2 thereon.

If the adhesion of the fine voids-containing resin layer 4 to the substrate 1, or the adhesion of the coloring material receptive layer 2 to the fine voids-containing resin layer 4 is insufficient, an adhesive or an adhesive layer of a resin capable of improving adhesion may be provided between the substrate 1 and the fine voids-containing resin layer 4, or between the fine voids-containing resin layer 4 and the coloring material receptive layer 2, although this embodiment is not shown in the drawing.

Figure 4:
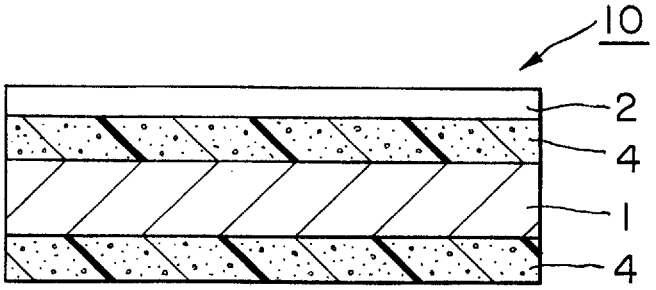

FIG. 4 shows the thermal transfer image-receiving sheet 10 of the construction illustrated in FIG. 3, in which a resin layer 4 having fine voids is also provided on the surface on the reverse side (rear surface) of the substrate 1 to the side where the coloring material receptive layer 2 is provided, the resin layer 4 being provided as an anticurl layer for increasing stability to curl.

The substrate 1 for use in the thermal transfer image-receiving sheet of the present invention is a paper or a paper-containing laminate. The paper consists mainly of naturally occurring wood pulp (cellulose fibers). As long as its area per flock is 6 $mm^2$ or less as stated previously, it may be any one such as wood free paper, chemical pulp-ground pulp paper, coat paper, art paper, cast coated paper, resin-impregnated paper or glassine paper.

The method of measuring the flocks comprises, for example, projecting light of a certain intensity and focused on a certain area onto a paper, scanning the light, and detecting the intensity of transmitted light. This method can give knowledge of the denseness or sparseness of the constituents of the paper, such as fibers, in the plane of the paper, or knowledge of the nonuniformity of the paper thickness.

In the present invention, the average area per flock was measured using 3D Flock Analyzer (M/K SYSTEMS, U.S.A.).

The paper-containing laminate includes, for example, the above-described paper extrusion-coated with polyolefin such as polyethylene, and laminated papers comprising the above paper and various plastic films laminated thereto with adhesives or the like.

Of the foregoing materials, the paper alone used for the substrate is preferably coat paper, art paper or cast coated paper, whereas the paper-containing laminate is preferably laminated paper containing polyethylene or the like.

The thickness of the paper for use in the substrate 1 is not restricted, but it is in such a progressive value that the usual ream weight is 73.3 to 157 $g/m^2$ in the case of coat paper, or 79.1 to 157 $g/m^2$ in the case of art paper. Since a slight increase or decrease from this value range is made possible by special paper making, the thickness may be selected as desired.

When laminated paper containing a plastic material such as polyethylene is used as the substrate 1, its adhesion to the layer laminated on its surface may be weak. In this case, its surface can be corona discharge treated, plasma treated, or primer coated with various materials.

On at least one surface of the above-mentioned substrate 1, the coloring material receptive layer 2 is provided. In this case, the coloring material receptive layer 2 can be directly provided on the surface of the substrate 1, or can be provided via the intermediate layer 3 as explained with regard to FIG. 2.

To improve the printability of the image-receiving sheet 10 further, it is preferred to additionally provide the resin layer 4, which has fine voids inside, at least on the surface of the substrate 1 on the side where the coloring material receptive layer 2 is formed (FIGS. 3, 4).

The resin layer 4 with the fine voids may be formed by coating the substrate 1 with a dispersion of hollow microspheres in a binder. Alternatively, it can be formed by coating the substrate 1 with a dispersion of thermally expansible microspheres in a binder, and then heating the coating to foam it. The resin layer 4 can also be formed by laminating on the substrate 1 a plastic film having fine voids inside, or synthetic paper having fine voids.

If the coloring material receptive layer 2 is provided only on one surface of the substrate 1, moreover, an anticurl layer can be provided, if desired, on the reverse surface (rear surface) of the substrate 1.

As the anticurl layer, the same resin layer as that provided on the coloring material receptive layer 2 side is preferred, since this will give a shrinkage percentage common to the face and back of the substrate 1. If, as stated earlier, the fine voids-containing resin layer 4 is provided on the coloring material receptive layer 2 side of the substrate 1, a similar fine voids-containing resin layer 4 can be provided on the reverse-side surface of the substrate 1 to serve as an anticurl layer (FIG. 4).

In the thermal transfer image-receiving sheet of the present invention, the coloring material receptive layer formed on at least one surface of the substrate accepts a coloring material, such as a sublimable dye, migrating from a thermal transfer sheet, and maintains a formed image. It may be any of known coloring material receptive layers used in the sublimation type thermal transfer system which consist essentially of resins dyeable with dyes.

Examples of the dyeable resins are known thermoplastic resins, such as polyester, polyurethane, polycarbonate, acrylic resin, polyvinyl chloride, and polyvinyl acetate, copolymers of these, and blends of these.

To prevent heat fusion to the thermal transfer sheet during printing, a releasing agent can be added to the coloring material receptive layer. Examples are phosphate esters, metal soaps, and silicones.

Of these materials, silicones are particularly preferred, and include, for example, dimethyl silicone and various modified silicones.

Examples of the modified silicones are amino-modified silicone, epoxy-modified silicone, alcohol-modified silicone, vinyl-modified silicone, and urethane-modified silicone. These modified silicone may further be blended, or polymerized using various reactions.

The suitable amount of the above-described coloring material receptive layer coated is normally in the range of 2.5 to 5.0 g/m$^2$ as a solids content.

The present invention will now be described in more detail by reference to the Examples and Comparative Examples.

Example 1

Art paper [High McKinley Deep Mat (Natural), Gojo Paper K. K., Japan] was used as a substrate in an amount of 127.9 g/m$^2$. To each surface of the substrate, a polypropylene film (35 m thick) having fine voids inside (Pearl SS P4255, Toyobo K. K., Japan) was bonded to make a laminate. On one surface of the laminate, a coloring material receptive layer coating solution of the composition indicated below was coated by a roll coater so that the amount of the coating when dry would be 4.0 g/m$^2$. The coating was dried to prepare a thermal transfer image-receiving sheet of Example 1.

The average area per flock of the High McKinley Deep Mat (Natural) was 5.99 mm$^2$.

Composition of coloring material receptive layer coating solution:

| | | Parts by weight |
|---|---|---|
| ① | Polyester (Byron 600, Toyobo) | 18 |
| ② | Vinyl-modified silicone (X-22-1212, Sin-Etsu Chemical Co., Ltd., Japan) | 2 |
| ③ | Platinum catalyst (CAT-PL-50T, Sin-Etsu Chemical Co., Ltd.) | 1 |
| ④ | Solvent (toluene) | 80 |

Example 2

The same procedure as in Example 1 was performed, except that the art paper as the substrate was replaced by 127.9 g/m$^2$ of Pearl Coat (coat paper of Mitsubishi Paper Mills K.K., Japan). As a result, a thermal transfer image-receiving sheet of Example 2 was prepared.

The average area per flock of the Pearl Coat was 5.73 mm$^2$.

Example 3

The same procedure as in Example 1 was performed, except that the art paper as the substrate was replaced by 127.9 g/m$^2$ of High McKinley Pure Dull (art paper of Gojo Paper K.K., Japan). As a result, a thermal transfer image-receiving sheet of Example 3 was prepared.

The average area per flock of the High McKinley Pure Dull was 4.89 mm$^2$.

Example 4

The same procedure as in Example 1 was performed, except that the art paper as the substrate was replaced by 127.9 g/m$^2$ of High McKinley Mat (art paper of Gojo Paper K.K.). As a result, a thermal transfer image-receiving sheet of Example 4 was prepared.

The average area per flock of the High McKinley Mat was 5.32 mm$^2$.

Example 5

The same procedure as in Example 1 was performed, except that the art paper as the substrate was replaced by 127.9 g/m$^2$ of High McKinley Elegance (art paper of Gojo Paper K.K.). As a result, a thermal transfer image-receiving sheet of Example 5 was prepared.

The average area per flock of the High McKinley Elegance was 3.70 mm$^2$.

Comparative Example 1

The same procedure as in Example 1 was performed, except that the art paper as the substrate was replaced by 127.9 g/m$^2$ of NK Highcoat (coat paper of Nippon Kakoh Seishi K.K., Japan). As a result, a thermal transfer image-receiving sheet of Comparative Example 1 was prepared.

The average area per flock of the NK Highcoat was 6.99 mm$^2$.

Comparative Example 2

The same procedure as in Example 1 was performed, except that the art paper as the substrate was replaced by 127.9 g/m$^2$ of New Top (coat paper of Oji Paper K.K., Japan). As a result, a thermal transfer image-receiving sheet of Comparative Example 2 was prepared.

The average area per flock of the New Top was 11.75 mm$^2$.

Comparative Example 3

The same procedure as in Example 1 was performed, except that the art paper as the substrate was replaced by 127.9 g/m$^2$ of New V Mat (coat paper of Mitsubishi Paper Mills K.K.). As a result, a thermal transfer image-receiving sheet of Comparative Example 3 was prepared.

The average area per flock of the New V Mat was 17.62 mm$^2$.

Comparative Example 4

The same procedure as in Example 1 was performed, except that the art paper as the substrate was replaced by 127.9 g/m$^2$ of OK Coat L (coat paper of Oji Paper K.K.). As a result, a thermal transfer image-receiving sheet of Comparative Example 4 was prepared.

The average area per flock of the OK Coat L was 15.96 mm$^2$.

Evaluations and Results

The thermal transfer image-receiving sheets of Examples 1 to 5 and Comparative Examples 1 to 4 prepared above were used as samples. Each sample was visually evaluated by the method described below. The results are expressed as symbols in Table 1. The average area per flock of the paper used as the substrate of each sample was measured using 3D Flock Analyzer (M/K SYSTEMS, U.S.A.). The measured values are also shown in Table 1.

(1) Method of visual evaluation

The thermal transfer image-receiving sheets of Examples 1 to 5 and Comparative Examples 1 to 4 were visually inspected by 10 panelists. These panelists evaluated the appearance, i.e., undulations or irregularities on the surface and the degree of their markedness, of each of these sheets, on a 5-grade scale with the highest grade as 5 points and the lowest grade as 1 point. The results given by the 10 panelists were summed, and the total score was classified according to the following criteria:

Evaluation Criteria 5 points: No undulations or irregularities, and excellent appearance (surface smoothness)

4 points: Minor undulations or irregularities, but relatively satisfactory appearance 3 points: Some undulations and irregularities, and somewhat poor appearance 2 points: Undulations and irregularities, and poor appearance 1 point: Marked undulations and irregularities, and remarkably poor appearance Classification Criteria ⊙: Total score of 40 points or more ○: Total score of 30–39 points Δ: Total score of 20–29 points X: Total score of 19 points or less

TABLE 1

| | Visual evaluation | Average area per flock [$mm^2$] |
|---|---|---|
| Ex. 1 | ⊙ | 5.99 |
| Ex. 2 | ⊙ | 5.73 |
| Ex. 3 | ○ | 4.89 |
| Ex. 4 | ○ | 5.32 |
| Ex. 5 | ○ | 3.70 |
| Comp. Ex. 1 | Δ | 6.99 |
| Comp. Ex. 2 | Δ | 11.75 |
| Comp. Ex. 3 | × | 17.62 |
| Comp. Ex. 4 | × | 15.96 |

As will become clear from the evaluation results shown in Table 1, the thermal transfer image-receiving sheets of Examples 1 to 5 using paper with an average area per flock of less than 6 $mm^2$ as the substrate bore few undulations or irregularities on the surface, and had visually excellent smoothness and appearance.

The thermal transfer image-receiving sheets of Comparative Examples 1 to 4 using paper with an average area per flock of more than 6 $mm^2$ as the substrate, by contrast, bore undulations and irregularities on the surface, although different in degree, and had visually poor smoothness and appearance.

The present invention is a thermal transfer image-receiving sheet comprising a substrate composed of paper or a laminate containing paper, and a coloring material receptive layer formed on at least one surface of the substrate, in which the paper for use in the substrate has an average area per flock of 6 $mm^2$ or less.

By adopting such a constitution, the sparseness and denseness of the fibers in the plane of the paper, and the nonuniformity of the thickness of the paper are decreased. As a result, a thermal transfer image-receiving sheet with smoothness and excellent appearance can be obtained which is free from undulations or irregularities extending over several millimeters on the surface.

Furthermore, a resin layer having fine voids inside is formed at least on the surface of the substrate on the side where the coloring material receptive layer is laminated. This means adding a layer having a uniform cushioning effect below the coloring material receptive layer. Thus, there can be provided a thermal transfer image-receiving sheet having better sensitivity during printing and high uniformity, and affording a high color density.

We claim:

1. A thermal transfer image-receiving sheet comprising:

a substrate composed of a paper or a laminate comprising a paper, and a coloring material receptive layer formed on at least one surface of the substrate, an average area per flock of the paper constituting the substrate being 6 $mm^2$ or less.

2. The thermal transfer image-receiving sheet of claim 1, wherein the substrate further has a resin layer having fine voids at least on the surface of the substrate on the side where the coloring material receptive layer is formed.

3. The thermal transfer image-receiving sheet of claim 1, wherein an intermediate layer is further provided between the substrate and the coloring material receptive layer.

* * * * *